US008403514B2

(12) United States Patent
Chang

(10) Patent No.: US 8,403,514 B2
(45) Date of Patent: Mar. 26, 2013

(54) LIGHTING CUP

(75) Inventor: Kuo-Cheng Chang, Miao-Li (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 0 days.

(21) Appl. No.: 13/272,227

(22) Filed: Oct. 13, 2011

(65) Prior Publication Data

US 2012/0127699 A1 May 24, 2012

(51) Int. Cl.
*F21V 33/00* (2006.01)

(52) U.S. Cl. ..... 362/101; 362/154; 215/387; 219/432

(58) Field of Classification Search ..... 362/101, 362/154, 253; 219/432; 40/324; 215/387; 426/82

See application file for complete search history.

(56) References Cited

U.S. PATENT DOCUMENTS

| | | | | |
|---|---|---|---|---|
| 4,523,083 | A * | 6/1985 | Hamilton | 219/433 |
| 4,864,921 | A * | 9/1989 | Ross | 99/279 |
| 5,553,735 | A * | 9/1996 | Kimura | 362/101 |
| 5,620,724 | A * | 4/1997 | Adler | 426/77 |
| 6,092,905 | A * | 7/2000 | Koehn | 362/101 |
| 6,352,352 | B1 * | 3/2002 | Schletterer et al. | 362/183 |
| 6,443,589 | B1 * | 9/2002 | Lee | 362/101 |
| 6,591,524 | B1 * | 7/2003 | Lewis et al. | 40/324 |
| 2005/0024858 | A1 * | 2/2005 | Johnson | 362/154 |

* cited by examiner

*Primary Examiner* — Peggy A. Neils
(74) *Attorney, Agent, or Firm* — Altis Law Group, Inc.

(57) ABSTRACT

An exemplary lighting cup includes a cup body, a lighting module, and a power module. The cup body is for containing drink therein. The lighting module is mounted on the cup body and includes lighting elements. The power module supports the cup body and electrically connects with the lighting module to drive the lighting elements to emit light.

12 Claims, 2 Drawing Sheets

LIGHTING CUP

BACKGROUND

1. Technical Field

The present disclosure relates to cups and, more particularly, to lighting cups.

2. Description of Related Art

Generally, cups are provided for accommodating liquid therein whereby a user can conveniently drink the liquid. The cup in common can not radiate light. Therefore, it is inconvenient for finding the cup at night when no light is available.

What is needed, therefore, is a lighting cup which can overcome the described limitations.

DETAILED DESCRIPTION

Figure 1:
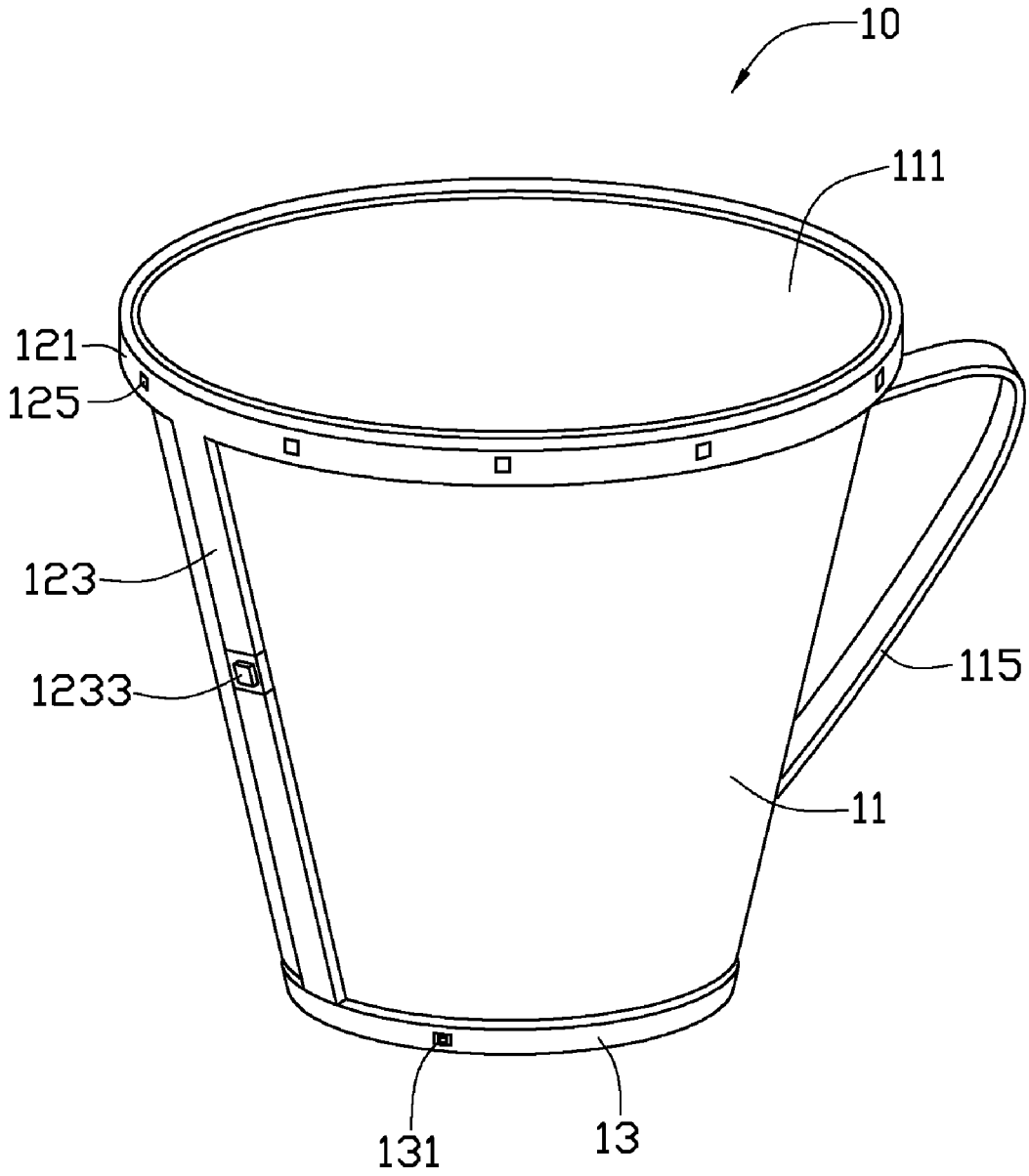
FIG. 1 is an assembled view of a lighting cup of an embodiment of the present disclosure.
Figure 2:
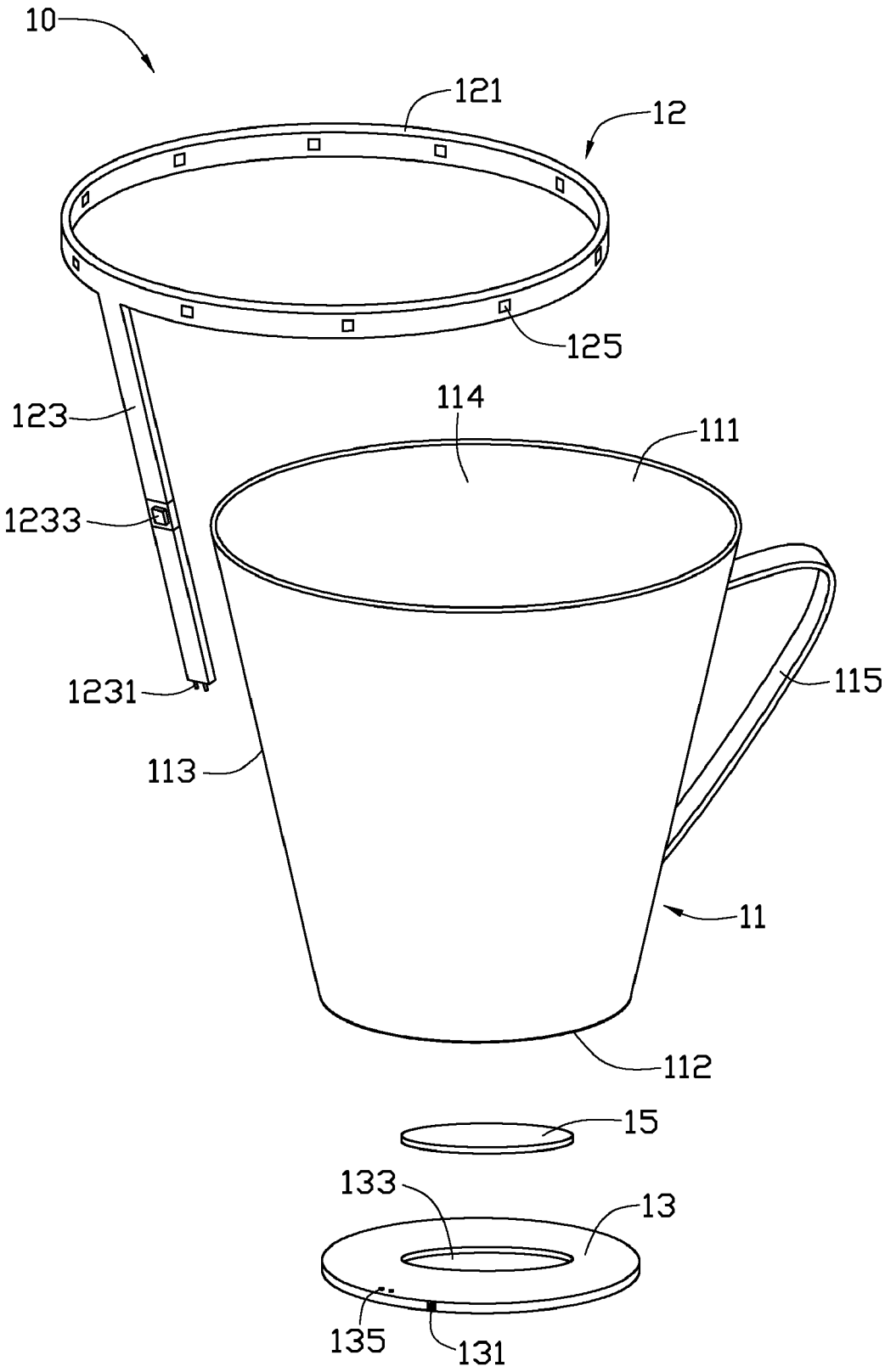
FIG. 2 is an exploded view of the lighting cup of FIG. 1.

Referring to FIGS. 1-2, a lighting cup 10 is shown. The lighting cup 10 includes a cup body 11, a lighting module 12 engaging with the cup body 11, a power module 13 located at a bottom end of the cup body 11, and a heating module 15 sandwiched between the cup body 11 and the power module 13.

The cup body 11 is made of electrically insulating materials, such as silicone, plastic, china or glass. Preferably, the cup body 11 is transparent. The cup body 11 includes a disk-like base 112 and a sidewall 113 extending upwardly from an outer periphery of the base 112. The sidewall 113 is hollow and has a shape of a truncated cone. The sidewall 113 and the base 112 cooperatively define a receiving space 114 therebetween to receive drink therein. A top end of the sidewall 113 defines an opening 111 therein. An inner diameter of the sidewall 113 generally increases from a bottom end connected the base 112 to the top end. A handle 115 is formed at an outer periphery of the sidewall 113 for facilitating holding of the cup body 11.

The lighting module 12 electrically connects with and is driven by the power module 13. The lighting module 12 includes a main body 121 and a connecting portion 123 extending from a side of the main body 121. The main body 121 is annular and light penetrable. Preferably, the main body 121 is transparent. A number of lighting elements 125 are received in the main body 121. In this embodiment, the lighting elements 125 are light emitting diodes (LEDs). An inner diameter of the main body 121 is slightly larger than an outer diameter of the top end of the sidewall 113 of the cup body 11. The main body 121 surrounds the top end of the sidewall 113.

The connecting portion 123 is a hollow straight bar and communicates with an interior of the main body 121. Two electrodes 1231 are formed on a bottom end of the connecting portion 123. Wires (not shown) are received in the connecting portion 123 and electrically connect the lighting elements 125 and the electrodes 1231. A protrusion 1233 is formed on an outside of the connecting portion 123 for hanging a tea bag thereon. When the lighting module 12 is assembled on the cup body 11, the connecting portion 123 is attached to an outer surface of the sidewall 113 of the cup body 11 and the electrodes 1231 are beyond the base 112 of the cup body 11 and electrically connects the power module 13. The lighting elements 125 are driven and emit light to show the lighting cup 10. Thus, it is easy for a user to find the lighting cup 10 at night.

The power module 13 includes a supercapacitor and has a disk-like configuration. A power interface 131 is defined in a lateral side of the power module 13 to allow the power module 13 to electrically connect with a power source. A recess 133 is defined in a middle of the power module 13 to receive the heating module 15 therein. Two mounting holes 135 are defined in a brim of the power module 13 to receive the electrodes 1231 of the connecting portion 123 of the lighting module 12 therein. A diameter of the power module 13 is larger than that of the base 112 of the cup body 11. The base 112 is located at a central portion of the power module 13 when the cup body 11 and the power module 13 are assembled together.

The heating module 15 which has a disk-like configuration is received in the recess 133 of the power module 13 and electrically connects with the power module 13. A top surface of the heating module 15 is coplanar with a top surface of the power module 13. The top surface of the heating module 15 thermally contacts the base 112 of the cup body 11 to heat the drink in the receiving space 114 of the cup body 11 when the heating module 15 is driven by the power module 13. The power module 13 can be equipped with a switch (not shown) to control the supply of power of the power module 13 to the lighting module 12 and/or the heating module 15 or not.

It is to be understood, however, that even though numerous characteristics and advantages of the embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A lighting cup comprising:

a cup body for containing drink therein;

a lighting module mounted on the cup body, the lighting module comprising a plurality of lighting elements;

a power module supporting the cup body and electrically connecting with the lighting module to drive the lighting elements to emit light; and a heating module electrically connecting with the power module and thermally contacting the cup body for heating the drink in the cup body;

wherein a recess is defined in the power module and the heating module is received in the recess; and wherein a top surface of the power module is coplanar with a top surface of the heating module, and the top surface of the heating module thermally contacts the cup body.

2. The lighting cup of claim 1, wherein the lighting module comprises a main body surrounding the cup body, and the lighting elements are received in the main body.

3. The lighting cup of claim 2, wherein the main body is transparent.

4. The lighting cup of claim 2, wherein the lighting module further comprises a connecting portion extending from the main body and electrically connecting with the power module.

5. The lighting cup of claim 4, wherein two electrodes are formed on the connecting portion, two mounting holes are defined in the power module, and the electrodes are received in the mounting holes and electrically connect with the power module.

6. The lighting cup of claim 4, wherein a protrusion is formed on an outer surface of the connecting portion, configured for hanging a tea bag thereon.

7. The lighting cup of claim 1, wherein each of the lighting elements is a light emitting diode.

8. The lighting cup of claim 1, wherein the power module includes a supercapacitor.

9. The lighting cup of claim 1, wherein a power interface is defined in the power module and configured for electrically connecting with a power source.

10. The lighting cup of claim 2, wherein the cup body comprises a base and a sidewall extending from the base, the main body surrounds the sidewall, and the heating module thermally contacts the base.

11. The lighting cup of claim 10, wherein the base is electrically insulating.

12. The lighting cup of claim 1, wherein the cup body is transparent.

* * * * *